US008448480B2

(12) United States Patent
Hasse et al.

(10) Patent No.: US 8,448,480 B2
(45) Date of Patent: May 28, 2013

(54) AUTOMATICALLY CONTROLLED WASHING MACHINE

(75) Inventors: Torsten Hasse, Nauen (DE); Sven Jänicke, Nauen (DE); Frank-Rüdiger Lüdtke, Berlin (DE); Ingo Schulze, Panketal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 734 days.

(21) Appl. No.: 12/664,911

(22) PCT Filed: Jun. 2, 2008

(86) PCT No.: PCT/EP2008/056799

§ 371 (c)(1), (2), (4) Date: Dec. 16, 2009

(87) PCT Pub. No.: WO2008/155214

PCT Pub. Date: Dec. 24, 2008

(65) Prior Publication Data

US 2010/0186461 A1 Jul. 29, 2010

(30) Foreign Application Priority Data

Jun. 20, 2007 (DE) ..... 10 2007 028 214

(51) Int. Cl.
*D06F 39/02* (2006.01)
*D06F 39/08* (2006.01)

(52) U.S. Cl.
CPC ..... *D06F 39/028* (2013.01); *D06F 39/02* (2013.01); *D06F 39/08* (2013.01)
USPC ..... 68/17 R; 68/207

(58) Field of Classification Search
CPC ..... D06F 39/02; D06F 39/028; D06F 39/08
USPC ..... 68/17 R, 207
See application file for complete search history.

(56) References Cited

U.S. PATENT DOCUMENTS 5,375,438 A * 12/1994 Babuin ..... 68/17 R
5,782,109 A * 7/1998 Spriggs et al. ..... 68/17 R (Continued)

FOREIGN PATENT DOCUMENTS

DE 3403622 A1 8/1985
DE 3525365 A1 1/1987

(Continued)

*Primary Examiner* — Joseph L Perrin
(74) *Attorney, Agent, or Firm* — James E. Howard; Andre Pallapies

(57) ABSTRACT

An automatically controlled washing machine having a detergent dispensing facility in an upper machine space of the washing machine, wherein the detergent dispensing facility has at least one chamber for hand-dosed addition of a portion of a powder detergent or a liquid detergent and a supply channel that supplies fresh water to the at least one chamber. At least one storage container in the upper machine space stores a liquid or gel-type detergent aid, which is automatically dosed by an automatic dosing facility assigned to the at least one storage container. The automatic dosing facility has a transfer line to supply a dose of the liquid or gel-type detergent aid to the washing machine tub. The supply channel has a bypass with an inlet side that is fluidly connected to the supply channel and an outlet side that is fluidly connected to the transfer line.

9 Claims, 2 Drawing Sheets

U.S. PATENT DOCUMENTS

| | | | | |
|---|---|---|---|---|
| 7,950,088 | B2 * | 5/2011 | Dalton et al. | 8/158 |
| 8,196,441 | B2 * | 6/2012 | Hendrickson et al. | 68/17 R |
| 2009/0090139 | A1 * | 4/2009 | Deppermann et al. | 68/17 A |
| 2009/0090140 | A1 * | 4/2009 | Deppermann et al. | 68/17 R |
| 2009/0090141 | A1 * | 4/2009 | Deppermann et al. | 68/17 R |
| 2009/0100881 | A1 * | 4/2009 | Dahlke | 68/17 R |

FOREIGN PATENT DOCUMENTS

| | | | |
|---|---|---|---|
| DE | 3933007 | A1 | 4/1991 |
| DE | 4014359 | A1 | 11/1991 |
| WO | 03/027377 | A1 | 4/2003 |

* cited by examiner

AUTOMATICALLY CONTROLLED WASHING MACHINE

BACKGROUND OF THE INVENTION

The invention relates to an automatically controlled washing machine with a detergent dispensing facility disposed in the upper machine space, said facility having at least one chamber for a hand-dosed addition of a portion of powder or liquid detergent and a supply channel for supplying fresh water for each chamber, with at least one storage container disposed in the machine space for liquid or gel-type detergent aid, to which a facility for the automatic dosing of the stored detergent aid is assigned, comprising a transfer line for supplying the dose to the washing machine tub.

Such a washing machine is known from DE 34 03 622 A1. In it is disposed a storage container for liquid detergent aids in the detergent dispensing facility behind the widely known chambers for supplying a manually dosed quantity of detergent aid. The transfer line from the dosing facility opens directly into the same channel to the tub as the fresh water supply, to which manually dosed detergent aids have been added. However for correct operation of the dosing facility the detergent drawer accommodating it and the chambers has to move out of the cavity of the housing of the detergent dispensing facility and back into it. This causes the automatically dosed quantity of detergent aid to be retained in an intermediate container, until it is subjected to the action of fresh water through its own fresh water channel and fed to the transfer line by way of a suction lifter.

Independently of this dosable detergent aid it is possible to supply manually dosed detergent to the laundry treatment process in the known manner from the detergent dispensing facility housed in the upper machine space. The known washing machine is thus structured in a complex manner with a plurality of additional facilities, leaving little space for the storage container. Only relatively small quantities can therefore be stored.

If however the automatically dosed quantity of detergent aid is to be supplied to the tub immediately without intermediate preparation, then a fresh water storage container kept separately at a sufficiently high level can be provided according to DE 39 33 007 A1 to flush out the transfer line, otherwise the transfer line would become encrusted or would gradually become blocked due to the coagulation of detergent residues. With the known apparatus the discharge lines of the storage facility, which are provided with a dosing facility, open into a premix chamber, from whence the mixture of fresh water and detergent dose is transported to the tub.

In a further known washing machine (DE 40 14 359 A1) the transfer line is integrated within a pressure sensor tube of a water level sensor. Since the pressure sensor tube has to open out very low down in the tub anyway, so that the water level can be detected reliably, the outlet opening of the transfer line is automatically always below the washing liquor level, so that the constantly wet opening is consistently flushed out. Deposits of encrusting or coagulating detergent aid are therefore impossible. However separate lines have to be positioned within the washing machine for this purpose, so that the automatically dosed quantity of detergent aid reaches the tub. If the washing machine is not used for a fairly long period, residues of the dosed detergent aid can however be deposited in the long line and solidify there.

Such stores of detergents or there components and their automatic metering and supply facilitate the customer's work considerably in respect of the replenishment of detergent aids. However all known washing machines have the shared disadvantage that dosed detergent residues can be deposited anywhere on the path to the tub and when solidified can cause operational failure. Frequent cleaning of such parts is unavoidable but difficult. This problem is resolved with one of the known washing machines (DE 39 33 007 A1) but so many additional measures are implemented for this purpose that the resulting additional outlay makes the machine unacceptably more expensive.

BRIEF SUMMARY OF THE INVENTION

The object of the invention is therefore to equip a washing machine of the type mentioned in the introduction so that when detergent aids are automatically dosed the risk of detrimental deposits is avoided without increasing the outlay for this purpose significantly. The invention also aims to achieve the shortest possible paths for an automatically dosed detergent aid and freedom from maintenance for the storage facility while avoiding the disadvantages set out above.

According to the invention this object is achieved in that at least one of the supply channels comprises a bypass, the inlet side of which has a fluid connection to the supply channel and the outlet side of which has a fluid connection to the transfer line. This means that with every surge of fresh water in the supply channel clean fresh water flows through the transfer line and cleans it. Any quantity of dosed liquid or gel-type detergent aid is flushed out of the transfer line leaving no residue so that the requirements of the specified object can be fulfilled. At the same time the customer is released from cleaning tasks in respect of detergent residues in this manner.

Because the bypass is connected on the inlet side to the supply channel which supplies the same chamber with inlet water as the transfer line with detergent aid, only the transfer line, which was just subjected to the action of dosed detergent aid is cleaned each time.

In a further development of the invention the bypass is coupled to the transfer line on the outlet side in close proximity to the storage container. This means that the transfer line is cleaned over its entire length.

The storage container is preferably positioned in a receiving space within the detergent dispensing facility. The space behind the drawer fitted with chambers for manual dosing can then be expediently utilized. It is large enough to hold a quantity of detergent aid sufficient for up to twenty washes. The dosing facility, e.g. a dosing pump, can be disposed in the storage container itself. The pressure side of the dosing facility is connected permanently to the transfer line to a chamber of the drawer or to the direct channel to the tub.

The transfer line is advantageously part of the detergent dispensing facility and the storage container can advantageously be connected by means of a coupling to the transfer line. This measure reduces the additional outlay for flushing measures for the transfer line quite decisively. It would also be similarly advantageous if according to a further development of the invention the bypass was also part of the detergent dispensing facility. To this end the bypass and/or transfer line can be configured as a cavity line in the top region of a housing for the detergent dispensing facility and optionally the bypass can be connected directly to the transfer line in the top region of the housing.

The features of the subclaims can be combined with one another or with the features of the main claim in any combination without departing from the invention.

BRIEF DESCRIPTION OF THE DRAWINGS

The invention is described in more detail below based on exemplary embodiments illustrated in the drawing, in which.

DETAILED DESCRIPTION OF EXEMPLARY EMBODIMENTS OF THE PRESENT INVENTION

Figure 1:
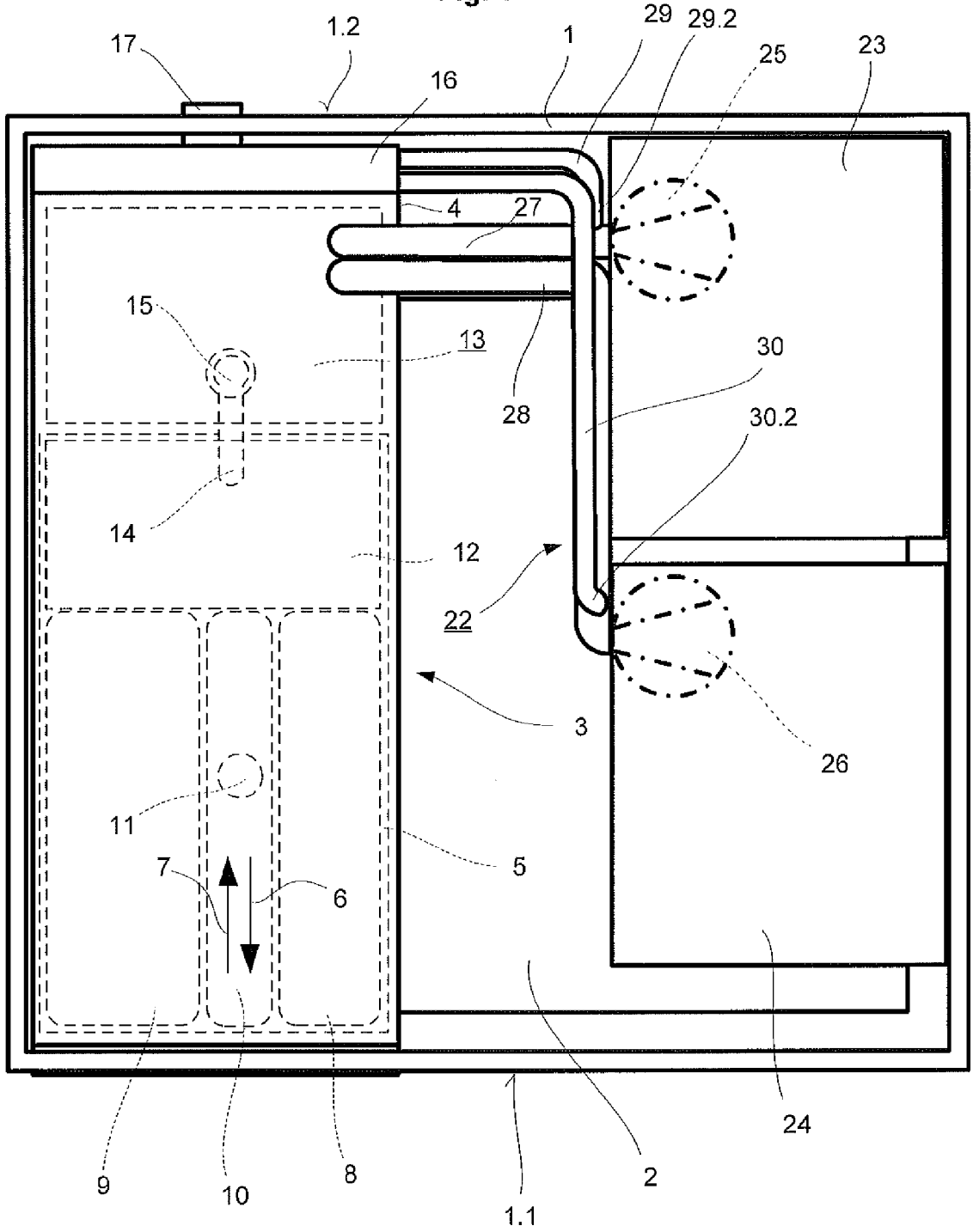
FIG. 1 shows a washing machine viewed from above with an inventively equipped detergent dispensing and storage facility and FIG. 2 shows another single storage facility for an inventively equipped washing machine with transfer and bypass lines for dosing detergent aid from a storage container disposed behind the drawer.

The housing 1 of the washing machine encloses a tub 2, which reaches so high up in the housing 1 that only the upper lateral remaining space within the housing 1 is available for the detergent dispensing facility 3. The detergent dispensing facility 3 has its own housing case 4, which extends from the front panel 1.1 of the housing 1 to its rear wall 1.2 and in which the drawer 5 is guided so that it moves freely in the pulling direction 6 or pushing direction 7. The drawer 5 has three detergent chambers 8, 9 and 10, which are open at the top, for pre-wash detergent (8), main wash detergent (9) and fabric conditioner (10). The fabric conditioner chamber 10 also has a suction lifter 11 (shown schematically). The rear ends of the chambers 8 and 9 and the suction lifter 10 open into a common discharge duct 12, which conveys the mixtures of detergent aid and water, which can be directed from above into the chambers, to the tub 2 in a manner not illustrated. One or more dosing lines 27, 28 can open into this space from storage containers 23, 24 for detergent aids (not shown here), which are disposed in the upper space of the washing machine outside the detergent dispensing facility. This solution is advantageous for such an arrangement of storage containers 23, 24, as no further facilities have to be provided to convey the detergent aid doses.

FIG. 1 shows a different solution. Here at least one fixed premix chamber 13 for a dose of a liquid or gel-type detergent aid is integrated in the housing 4 of the detergent dispensing facility 3 behind the duct 12 outside the drawer 5. The premix chamber(s) 13 is/are tailored in shape and size to the respective space still available behind the chambers 8 to 10 of the drawer 5 and remain fixed in the housing 4 at all times, even when the drawer 5 is moved. When a single premix chamber 13 is housed in the housing 4, a dose of up to 500 ml detergent aid can be stored.

At its base the premix chamber 13 has a discharge opening 14 with a suction lifter 15 like the chamber 10 for fabric conditioner. In the case of an arrangement with a number of premix chambers 13 a corresponding number of suction lifters 15 with discharge openings 14 should of course be provided, all opening into the same discharge duct 12.

A magnetic valve assembly 16 can also be disposed in the rear region of the housing case 4 to fill the chambers 8 to 10 and 13. To fill all the chambers with fresh water from the respectively associated magnetic valve, guide channels 18.*x* and spray nozzles (not shown) are disposed in the known manner in the top region of the housing 4 of the detergent dispensing facility 3, so that only the respective chamber, the water supply channel of which is activated, is subjected to the action of the assigned fresh water flow. For the chamber 8 therefore the channel directed downward to the left (arrow 19) is activated, for the chamber 9 the channel directed downward to the right (arrow 20) is activated and for the chamber 10 the channel directed vertically downward, resulting from the two above-mentioned channels (arrow 21) is activated. The magnetic valve assembly 16 is also supplied with fresh water from a domestic water supply system (not shown) by way of a central supply inlet 17. The premix chamber 13 has its own water supply channel.

On the right side of the upper structural space within the machine housing 1 the free space available there is filled by a storage facility 22, which can accommodate one or—as shown here—two storage containers 23 and 24. Each storage container is assigned a dosing facility 25, 26, which essentially comprises a pump. The suction side of each pump communicates with the interior of the assigned storage container 23, 24 and the pressure side of each pump communicates with an assigned transfer line 27 or 28. These lines 27 and 28 open—together here—into the premix chamber 13, which is not detrimental if the second dosing facility 26 is only called into use after the dose of detergent aid stored on an intermediate basis in the premix chamber 13 has already been flushed out of the first storage container 23. If however two fixed premix chambers are provided, each of the transfer lines 27 and 28 can open out in one of the premix chambers respectively.

Two more lines, bypass 29 and bypass 30, lead from the valve block 16 to the pressure sides of the dosing facilities 25 and 26. Their outlet sides 29.2 and 30.2 are coupled to the transfer lines 27 and 28 there. On the inlet side in the valve block 16 the bypasses respectively have a connection to a supply channel for the premix chamber 13 or for one of the chambers 8 to 10, so that the bypass in question always conveys fresh water when the associated chamber 8 or 9 or 10 or 13 is acted on. The fresh water in the respective bypass 29 or 30 then flushes any detergent aid residues out of the associated transfer line 27 or 28.

Figure 2:
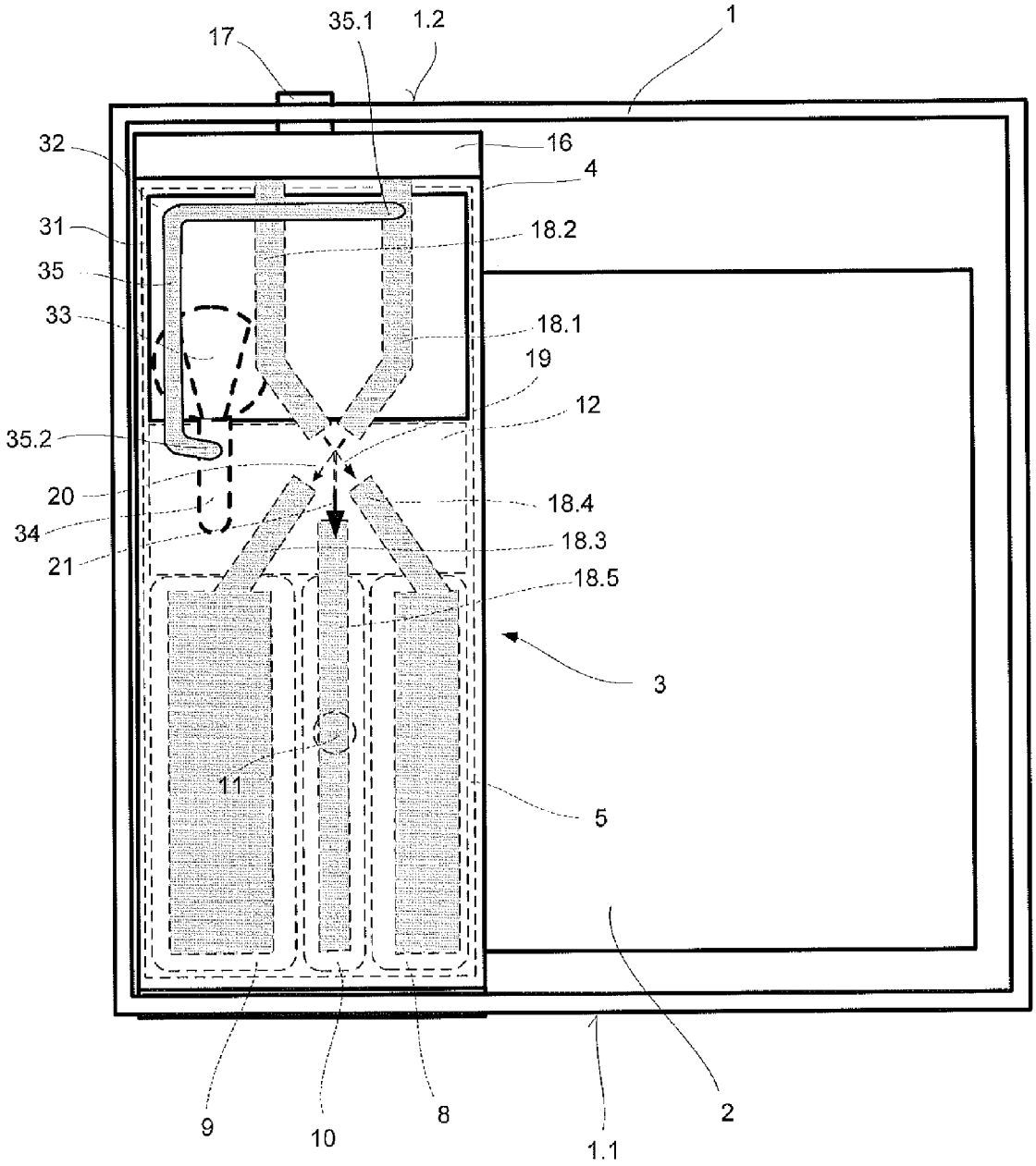

FIG. 2 shows another variant of the storage, dosing and supply of automatic doses of detergent aid. To this end, instead of a premix chamber 13 (FIG. 1) and storage containers 23 or 24 in FIG. 1 a receiving facility 31 is provided for a storage container 32, which is a storage container that can be transported and marketed and can be distributed by a detergent manufacturer. A dosing apparatus 33 is disposed in the receiving facility 31, which forms a case-type space, to the suction side of which dosing apparatus 33 a coupling part for the storage container 32 used is connected (not shown in detail here). The pressure side of the dosing apparatus 33 is connected to the transfer line 34, through which the dosed detergent aid and flushing liquid is supplied on a direct path through the discharge duct 12 to the tub 2. The inlet side 35.1 of the bypass 35 also connects the supply inlet 18.1 on the outlet side (35.2) to the transfer line 34, so that when water passes through the supply inlet 18.1, detergent residues are flushed out of the transfer line 34.

The supply lines 18.*x* and the bypass 35 are parts of a top part (not shown in detail) of the housing 4 of the detergent dispensing facility 3. The supply lines 18.1 and 18.2 are connected to the magnetic valves (not shown in detail) in the valve block 16, conveying water when the chamber 9 or 8 is to be flushed. If only the supply line 18.1 conveys water, then the line 18.3 receives this water according to the arrow 20 and directs it into the chamber 9. Similarly the line 18.4 receives the water from the supply line 18.2 according to the arrow 19 and directs it to the chamber 8. If both supply lines 18.1 and 18.2 convey water, a resulting jet forms in the free air gap according to the arrow 21, which is received by the line 18.5 and directed to the chamber 10.

Each time the chamber 9 is flushed, flushing water acts on the transfer line 34 by way of the bypass 35. This is not detrimental if no detergent aid has been dosed from the storage container 32 but just a manual dose of detergent has been transferred from the chamber 9 into the tub 2. If automatic dosing is activated however, then instead of a manual dose from the chamber 9 (assumed not to be present) the dosing apparatus 33 will convey a portion of liquid detergent aid from the storage container 32 into the discharge duct 12. So that enough water is also available to dilute the portion of detergent aid, the supply channel is also activated by way of the line 18.1, supplies inlet water to the tub 2 by way of the chamber 9 and flushes the transfer line 34 out by way of the bypass 35.

The structure of the dosing facilities 25, 26 and 33 is not shown in further detail. It can either be configured according to the prior art from DE 34 03 622 A1 or in a different manner with conveyor facilities (magnetic valve, pump, shutters) for the detergent aid store from the storage container 23, 24 and 32 either without pressure or subject to pressure.

The invention claimed is:

1. An automatically controlled washing machine, comprising:

a tub;

a detergent dispensing facility disposed in an upper machine space of the automatically controlled washing machine, the detergent dispensing facility having at least one chamber for hand-dosed addition of a portion of one of a powder detergent and a liquid detergent and at least one supply channel to supply fresh water to the at least one chamber;

at least one storage container disposed in the upper machine space to store one of liquid detergent aid and gel-type detergent aid;

an automatic dosing facility assigned to the at least one storage container, the automatic dosing facility to automatically dose the one of the liquid detergent aid and the gel-type detergent aid stored in the at least one storage container, and the automatic dosing facility having a transfer line to supply a dose of the one of the liquid detergent aid and the gel-type detergent aid to the tub of the automatically controlled washing machine;

wherein the at least one supply channel has a bypass having an inlet side and an outlet side; and wherein the inlet side of the bypass is fluidly connected to the supply channel and the outlet side of the bypass is fluidly connected to the transfer line.

2. The washing machine of claim 1, wherein the inlet side of the bypass is connected to the at least one supply channel that supplies the same of the at least one chamber with the fresh water as the at least one chamber that the transfer line supplies with the one of the liquid detergent aid and the gel-type detergent aid.

3. The washing machine of claim 1, wherein the outlet side of the bypass is coupled to the transfer line in a predetermined proximity to the at least one storage container.

4. The washing machine of claim 1, wherein the at least one storage container is disposed in a receiving space within the detergent dispensing facility.

5. The washing machine of claim 4, further comprising a coupling to connect the at least one storage container to the transfer line, wherein the transfer line is part of the detergent dispensing facility.

6. The washing machine of claim 5, further comprising a housing for the detergent dispensing facility, the housing having a top region, wherein the transfer line is a cavity line disposed in the top region of the housing.

7. The washing machine of claim 6, wherein the bypass is connected directly to the transfer line in the top region of the housing.

8. The washing machine of claim 1, wherein the bypass is part of the detergent dispensing facility.

9. The washing machine of claim 8, further comprising a housing for the detergent dispensing facility, the housing having a top region, wherein the bypass is a cavity line disposed in the top region of the housing.

* * * * *

UNITED STATES PATENT AND TRADEMARK OFFICE

CERTIFICATE OF CORRECTION

PATENT NO. : 8,448,480 B2
APPLICATION NO. : 12/664911
DATED : May 28, 2013
INVENTOR(S) : Hasse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 775 days.

Signed and Sealed this
Eighth Day of September, 2015

Michelle K. Lee

Michelle K. Lee
*Director of the United States Patent and Trademark Office*